US007549442B2

(12) United States Patent
Jones

(10) Patent No.: US 7,549,442 B2
(45) Date of Patent: Jun. 23, 2009

(54) INTAKE FOR VERTICAL WET PIT PUMP

(75) Inventor: Garr Morgan Jones, Whitefish, MT (US)

(73) Assignee: Brown and Caldwell, Walnut Creek, CA (US)

( * ) Notice: Subject to any disclaimer, the term of this patent is extended or adjusted under 35 U.S.C. 154(b) by 0 days.

(21) Appl. No.: 12/023,832

(22) Filed: Jan. 31, 2008

(65) Prior Publication Data

US 2008/0187448 A1 Aug. 7, 2008

Related U.S. Application Data

(60) Provisional application No. 60/887,805, filed on Feb. 1, 2007.

(51) Int. Cl.
*B65D 88/32* (2006.01)
*B65D 88/54* (2006.01)

(52) U.S. Cl. ..... 137/565.37; 137/574; 137/590

(58) Field of Classification Search ..... 137/565.37, 137/574, 590; 222/464.1, 464.7
See application file for complete search history.

(56) References Cited

U.S. PATENT DOCUMENTS

| | | | | | |
|---|---|---|---|---|---|
| 1,792,827 | A * | 2/1931 | Farkas | 137/590 |
| 1,894,655 | A * | 1/1933 | Auchincloss | 137/590 |
| 2,072,944 | A | 3/1937 | Durdin | |
| 2,174,354 | A * | 9/1939 | Shields | 137/590 |
| 3,223,039 | A * | 12/1965 | Cowan | 137/590 |
| 3,501,067 | A * | 3/1970 | Rigor | 222/464.1 |
| 3,636,976 | A * | 1/1972 | Hansel | 137/590 |
| 4,033,875 | A | 7/1977 | Besik | |
| 4,219,047 | A * | 8/1980 | Polley | 137/590 |
| 5,435,664 | A | 7/1995 | Pettersson | |
| 5,833,434 | A | 11/1998 | Stahle | |
| 6,058,964 | A * | 5/2000 | Cotton et al. | 137/590 |
| 6,227,412 | B1 * | 5/2001 | Sweeton | 222/464.1 |
| 6,523,561 | B2 * | 2/2003 | Kapcoe et al. | 137/590 |
| 7,225,824 | B2 * | 6/2007 | West et al. | 137/590 |
| 2003/0056838 | A1 * | 3/2003 | Grayson | 137/590 |
| 2006/0065310 | A1 * | 3/2006 | West et al. | 137/590 |

* cited by examiner

*Primary Examiner*—John Rivell
(74) *Attorney, Agent, or Firm*—Morgan, Lewis & Bockius LLP; Victor E. Johnson

(57) ABSTRACT

A pump intake apparatus for directing fluid flow to a pump. The pump intake assembly includes a pump intake column having a pump bell and a pump intake pit. The intake pit includes an upper intake pit encircling the pump intake column and has a tapered inner surface providing the upper intake pit with a decreasing cross-sectional area to accelerate the fluid flow toward the pump bell. The upper intake pit may include at least one vane extending inwardly from the inner surface of the upper intake pit to suppress rotation of a fluid flowing through the upper intake pit. The intake pit further includes a lower intake pit floor positioned substantially below the pump bell and including a projection member upwardly extending from a central region of the lower intake pit floor toward the pump bell. The lower intake pit floor has a substantially curvilinear surface interconnecting the upper intake pit to the projection member to redirect and accelerate fluid flow toward the pump bell. The intake assembly may include a shroud extending from the lower end of the pump intake column to also facilitate acceleration of fluid flow toward the bell portion of the pump. A method of using the pump intake is also disclosed.

17 Claims, 4 Drawing Sheets

INTAKE FOR VERTICAL WET PIT PUMP

CROSS-REFERENCES TO RELATED APPLICATIONS

This application claims priority to U.S. Provisional Patent Application No. 60/887,805 filed Feb. 1, 2007 and entitled INTAKE FOR VERTICAL WET PIT PUMP, the entire contents of which is incorporated herein by this reference.

TECHNICAL FIELD OF THE INVENTION

This invention relates, in general, to a pump intake assembly and more particularly to an intake assembly for directing the flow of a fluid to a wet pit pump and methods for their use.

BACKGROUND OF THE INVENTION

In modern industrial applications, fluid pumps have found use in many applications where large bodies of fluids need to be transported from one location to another. Fluid pump systems allow fluid to be stored at a location remote from a source so it can then be distributed quickly and easily. For example, pump systems are commonly used to provide drinking water from storage wells, move water from a storage well to a fire, and to provide water to power generating plants. Fluid pumps are also used to remove undesirable fluid from various locations. For example, fluid pumps are used to remove wastewater, drain floodwaters, and eliminate stormwater.

In such applications it is imperative that the fluid to be pumped is directed to the pump quickly and without interruption and turbulence. If flow to the pump slows or is turbulent, the pump output and efficiency will be negatively affected. If air or gaps in the flow are present, the pump may fail or lose capacity. In the alternative, if smooth flow is provided to the pump at a proper rate the pump will operate smoothly and efficiently. In addition to decreasing operating costs by increasing pump efficiency and effectiveness, smooth intake flow to the pump lengthens the pump life and lowers maintenance costs.

A problem common to all these pumping applications stems from the formation of vortices or flow disruptions in the fluid during pumping. Because many such applications involve high-throughput pumps, it can be difficult to efficiently transport the fluid flow from the storage tank to the pump while avoiding flow problems. In particular, various components or features in the intake system along the flow path tend to disrupt the flow of the fluid.

Such disruptions yield uneven and inefficient fluid flow, with the likely development of vortices and vapor cavities and the loss of adequate energy at the pump inlet. Severe turbulence can lead to "whitewater," which is the introduction of large quantities of air into the fluid, reducing pump capacity and causing mechanical disruption of the pump operation. Even mild flow distortions can disrupt normal pump operation. For example, introduction of vapor cavities or bubbles into the pump can cause vibrations in the pump that reverberate throughout the pump system.

Vortex types caused by nonuniform flow are generally categorized into six types depending on severity of flow disruption. By way of example, type 1, the most mild, is a surface swirl whereby the surface of the fluid has been disrupted but the swirl is not coherent. "Coherent" means the surface vortex is connected to subsurface vortices. Type 4 is a vortex that pulls contaminant solids from the surface through the vortex column. Type 5 occurs when air is pulled into the vortex. The most severe vortex, type 6, occurs when a full air core extends to the pump inlet.

Over the years, several methods have been developed to prevent the formation of vortices in the fluid and provide acceptable fluid characteristics at the pump inlet. Early methods for creating efficient flow utilized large structures and complex baffling systems. These designs are commonly referred to as 'shoe-box' intakes. Other designs use specially fabricated tubes, termed Formed Suction Inlets, or FSIs, attached to the pump inlet bell to characterize and direct the fluid properly toward the pump inlet. All of these intake structures are characterized by the presumption that the fluid entering the pump must approach the pump inlet at the level of the inlet from a substantial distance away from the pump. Fluid is drawn through the inlet structure from the bottom of the approach conduit or channel where the currents from the upstream conduit or canal are likely to encourage the development of vortices and cause unacceptable turbulence at the pump inlet.

These early methods facilitate pumping by moving the fluid from the bottom of the tank, but they do not fully overcome the problem of vortex formation and swirling exacerbated by the demands of modern applications. The structures and FSIs required by these methods prove to be expensive, requiring considerable excavation, dewatering and extensive construction activity to fabricate and install. Inevitably, the performance of these intake designs are adversely affected by local influences such as other pumps in operation or changes in direction of the fluid flow in the structure approaching the intake. All of these designs are predicated on the assumption that the fluid approaching the intake is uniform and free from disturbances that would result in swirling or high energy currents approaching the intake. Even though the fluid flow is well distributed approaching these intakes, the localized influences noted previously may result in swirling and a vortex may still result. In particular, swirls can be created at or near the surface and at the inlet to the pump. The swirls in turn lead to flow defects that degrade the performance of the pump. All these problems are exaggerated when the flow rate is increased, localized influences effect the uniformity of fluid approach conditions, and the like. In practice, nearly all such intakes require after the fact modification to add special features to defeat swirl and vortex formation as well as correction of tendencies to develop floor, wall and ceiling separation phenomena that further encourages turbulent condition at the pump inlet.

Swirls in most intake designs develop in several key areas. Most notably, as the fluid flows to the intake it accelerates, but not uniformly. Instead, the fluid tends to follow floors and walls in the intake structure and it is at these locations where the greatest rate of acceleration of the fluid is encountered. Vortices often develop because this acceleration is not uniform. Also, corners and non-uniform curves in the intake structure creates pockets that encourage eddies and vortices in the fluid flow. Second, at the bottom of the tank, vortices often develop as the fluid is abruptly redirected from a downward flow to an upward direction into the pump intake. This abrupt acceleration change causes vortices near the pump inlet. It also slows the feed rate to the pump.

Many intake designs require substantial submergence, usually twice the pump bell diameter, to suppress the formation of surface swirling that could develop into Type 3 or higher vortices.

Other methods have expanded upon the idea of feeding the pump through a tube by configuring the tank to direct the fluid to a mouth of the tube. Examples of several such conventional tank designs include U.S. Pat. No. 2,072,944 to Durdin, U.S. Pat. No. 5,435,664 to Pettersson, and U.S. Pat. No. 4,033,875 to Besik. Such tank designs include a sloping portion at a bottom of the tank which concentrates flow at the inlet to the pump intake tube. The sloped tank walls also accelerate fluid as it approaches the inlet of the pump intake tube. The increased pressure at the tube inlet alleviates the burden on the pump because it does not have to draw the fluid with as much force. However, such tank designs present the same flow problems as previous intake designs. Vortices and eddies near the intake tube opening are common given the high pressure forcing fluid into the pump inlet.

Several modern methods have used knowledge of fluid transfer properties to redesign the pump intake assembly to try to create uniform flow. One method disclosed in U.S. Pat. No. 5,833,434 to Stahle involves the submersion of the pump and an intake tube into a casing configured to enhance the swirling of fluid rather than prevent it. Stahle discloses a casing with channels that concentrate the swirling flow into a swirling vertical path towards the pump. Although this method directs the flow of fluid into the intake pump, the increased swirling leads to vortices that allow the introduction of air in the bottom of the tank and similar problems. The swirling beneath the surface of the fluid also involves shearing between different flow paths, which actually increases the likelihood of vortex formation.

Another intake tube design includes a pit extending downward from a bottom of the tank. The pit is positioned near the center of the tube in order to prevent flow problems from interactions of the flow with the tank walls. However, the fluid still has a tendency to swirl as it moves down the pit to the intake tube inlet. The sharp corners formed by the upper lip of the pit at the bottom of the tank floor also create an additional location for the formation of vortices and the sharp corners do not have any effect on the potential for mal-distribution of fluid around the cross-section of the pit. In order to overcome this problem, one intake assembly design includes a weir surrounding the pit entry. The weir acts as a flow distributor as well as a barrier to eliminate floor currents in the tank.

Such designs further act to isolate the incoming flow from the inlet to the pump inlet and more uniformly distribute flow as it moves near the pump inlet, but they do not eliminate the problems discussed above. Vortices are still likely to develop as the fluid is redirected into the intake tube unless the flow is slow over the weir. Typically, the flow must be at or below 1 foot/sec. over the submerged weir. The flow of fluid over the weir also tends to create small swirls that can attach to other flow disruptions and act on the pump.

What is needed is an intake assembly that overcomes the above problems. In particular, what is needed is an intake assembly that creates a uniform, distributed flow from an inlet in the tank all the way to the pump inlet bell. What is needed is an intake assembly that suppresses vortex formation in the fluid. What is needed is an intake tube assembly with fewer areas in which a vortex is likely to develop.

Further, what is needed is an intake assembly that allows for efficient, high-throughput operation of a pump. What is needed is an intake assembly that increases pump capacity. What is needed is an intake assembly that minimizes cost of construction, including excavation, yet achieves all of the above objectives.

BRIEF SUMMARY OF THE INVENTION

The present invention is directed at reducing the depth of excavation and cost of construction of intakes for vertical wet pit pumps by using principles of hydraulic design and fluid mechanics to effect uniform distribution of fluid at the intake entrance in a manner that will be largely unaffected by fluid conditions approaching the intake and condition the fluid characteristics approaching the pump inlet to effect a seamless entrance into the pump with no objectionable swirling or turbulence at the pump entrance.

In summary, one aspect of the present invention is directed to a wet pit pump intake assembly for directing fluid flow to a pump. The pump intake assembly includes a pump intake column including a lower end having a pump bell and a pump intake pit. The intake pit includes an upper intake pit encircling the pump intake column and has a tapered inner surface providing the upper intake pit with a decreasing cross-sectional area to accelerate the fluid flow toward the pump bell. The upper intake pit may include at least one vane extending inwardly from the inner surface of the upper intake pit, wherein the vane is configured to suppress rotation of a fluid flowing through the upper intake pit. The intake pit further includes a lower intake pit floor positioned substantially below the pump bell and including a projection member upwardly extending from a central region of the lower intake pit floor toward the pump bell. The lower intake pit floor has a substantially curvilinear surface interconnecting the upper intake pit to the projection member to redirect and accelerate fluid flow toward the pump bell.

In one embodiment, the wet pit pump intake assembly is provided in combination with a fluid basin having a weir extending upwardly from a floor of the fluid tank, wherein the pump intake assembly extends downwardly from the fluid tank floor and is configured to control the flow of fluid from the fluid tank into the pump bell.

The upper intake pit may be in the shape of an inverted cone. The lower intake pit floor may be toroidally shaped. A top point of the projection may extend above a lower edge of the pump intake column. In one embodiment, the intake assembly further includes a shroud extending from the lower end of the pump intake column, which may include a bowl and bell portion to the pump column. The shroud is configured to facilitate acceleration of fluid flow toward the bell portion of the pump. The shroud may completely cover the pump bowl and bell portion from the fluid flow.

In one embodiment, the vane has an inner edge substantially parallel to the intake throat and the outer edge in contact with the pit wall. The vane may have a triangular shape. The vane may be substantially flat. The vane may be dimensioned and configured to minimize turbulence of fluid flowing over its surface. The vane may have a dimpled surface. In one embodiment, four or more vanes are spaced equidistantly on the inner surface of the pit wall.

The intake assembly may further include a distribution weir in the form of a circular band having the pit entrance at its center.

Another aspect of the present invention is directed to a wet pit pump intake assembly for directing fluid flow to a wet pit pump. The pump intake assembly includes an intake pump column including a pump bell portion and a pump bowl portion, and a pump intake pit. The pump intake pit includes an upper intake pit encircling at least the pump bell and having an inner surface providing the upper intake pit with a decreasing cross-sectional area to accelerate the fluid flow toward the pump bell, and a lower intake pit floor positioned substantially below the pump bell and including a projection member upwardly extending from a central region of the lower intake pit floor toward the pump bell to redirect fluid flow toward the pump bell. The wet pit pump intake assembly may include a shroud extending from the lower end of the pump intake column and encircles the bowl portion and the bell portion, wherein the shroud is configured to facilitate acceleration of fluid flow toward around the bell portion of the pump. Preferably, the inner surface of the upper intake is tapered to accelerate the fluid toward the pump bell.

The intake assembly of the present invention has other features and advantages which will be apparent from or are set forth in more detail in the accompanying drawings, which are incorporated in and form a part of this specification, and the following Detailed Description of the Invention, which together serve to explain the principles of the present invention.

DETAILED DESCRIPTION OF THE INVENTION

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

For convenience in explanation and accurate definition in the appended claims, the terms "up" or "upper" and "down" or "lower" are used to describe features of the present invention with reference to the positions of such features as displayed in the figures.

Figure 1:
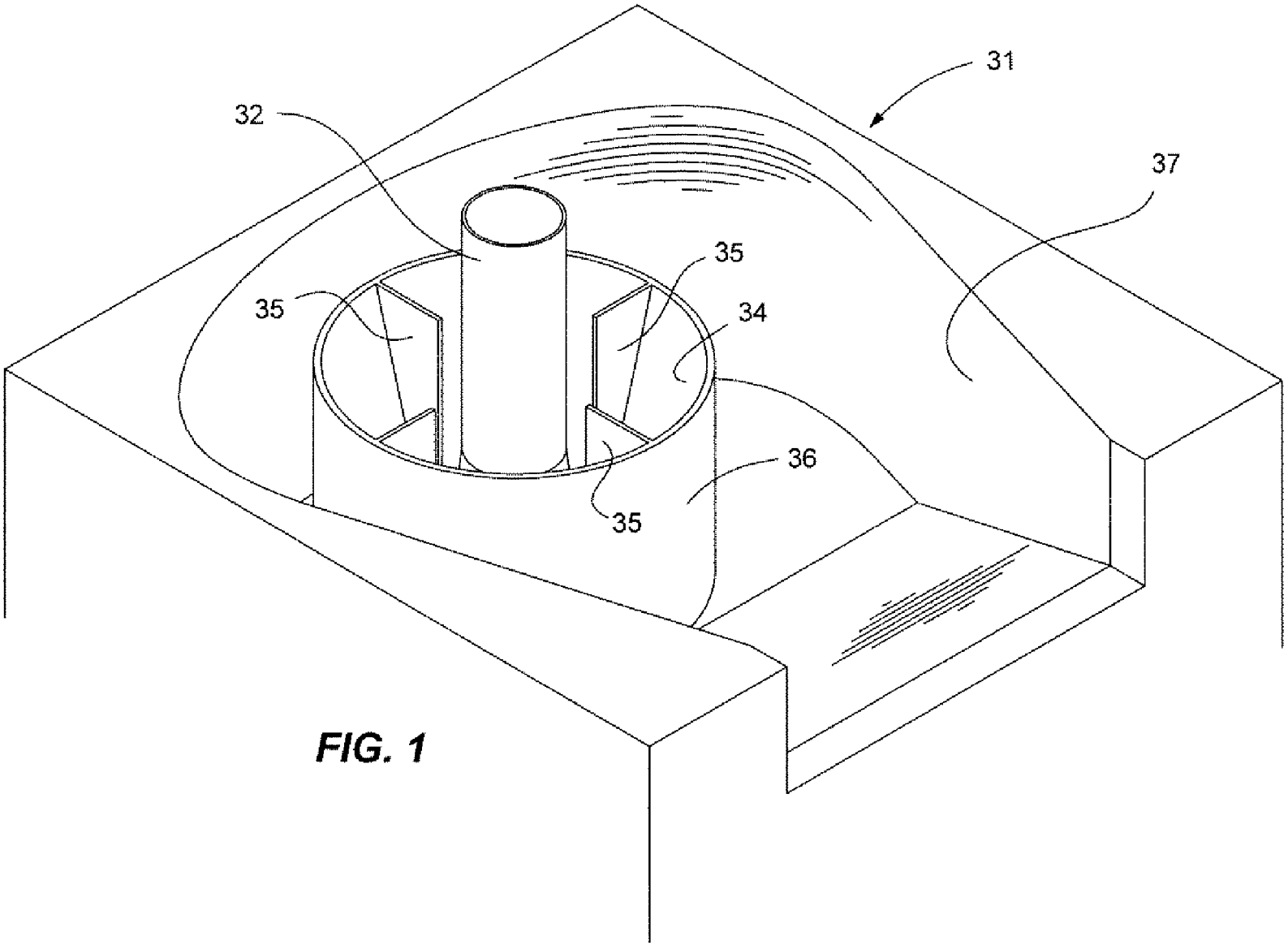
FIG. 1 is an isometric view of a pump intake assembly in accordance with the present invention incorporating the inventive features of the proposed design.

Turning now to the drawings, wherein like components are designated by like reference numerals throughout the various figures, attention is directed to FIG. 1 illustrating a pump system, generally designated 31, in a pump station environment. In the illustrated embodiment, the pump system includes a pump column assembly including the pump bowl assembly and the shroud (not shown in FIG. 1, but which is a part of this invention), generally designated 32, which discharges to a piping system through a pump discharge head. A submerged distribution weir, designated 33, sized to provide a nominal fluid flow, for example 3 feet per second or more at the peak rate, of pumping and the lowest operational water surface elevation in the intake. This feature forces balanced distribution (unit flow per unit time per unit length of weir). One will appreciate that other configurations may be provided to accommodate for other flow desired rates.

After passing over the submerged weir 33, the flow enters an inverted cone 34, which is radially, or inward, turning vertically and following the cone toward the pump intake bell. "Inward" means a lateral direction from the weir to the pump column.

The combination of the inverted cone 34 and the shroud 39 affixed to the pump column (see pump column 38 in FIG. 3) provide a decreasing cross section pathway designed to accelerate the fluid as it progresses toward the pump inlet bell. In accordance with the present invention, the inverted cone configuration and the shroud configuration provide smooth acceleration and prevent the formation of vortices and unstable flow characteristics in the fluid.

One or more radial vanes 35 provide correction and stability to the fluid as it accelerates and flows toward the pump intake bell. As will be understood by one skilled in the art, the configuration and use of plates, weirs, and other flow distribution members may vary depending on the application, in particular, the type of fluid and flow rate.

An intake projection 36 is provided above an intake basin 37 floor. One will appreciate that the intake projection may be any height necessary for the regulation and transport of the fluid to the submerged weir 33.

Figure 2:
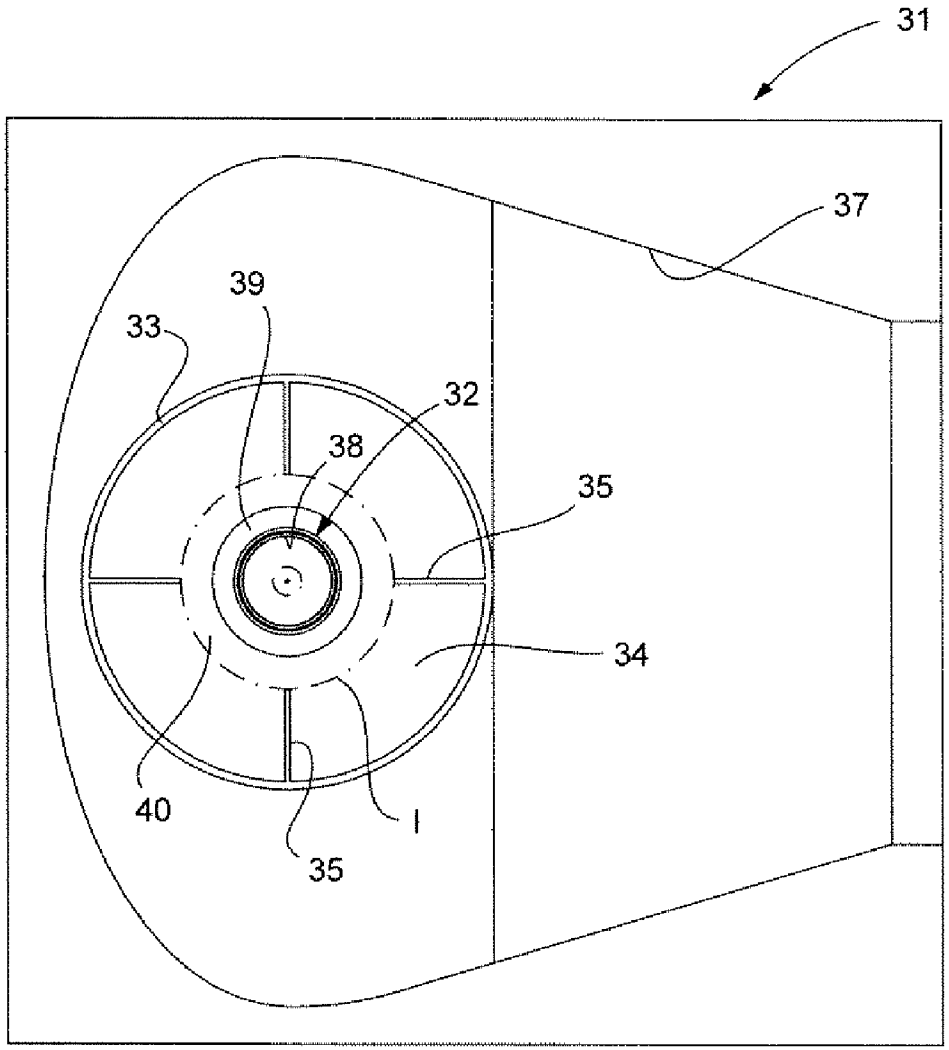
FIG. 2 is a top plan view of the pump intake assembly of FIG. 1.

With reference to FIG. 2, a plan view of the intake is shown illustrating the positions of the various features.

Figure 3:
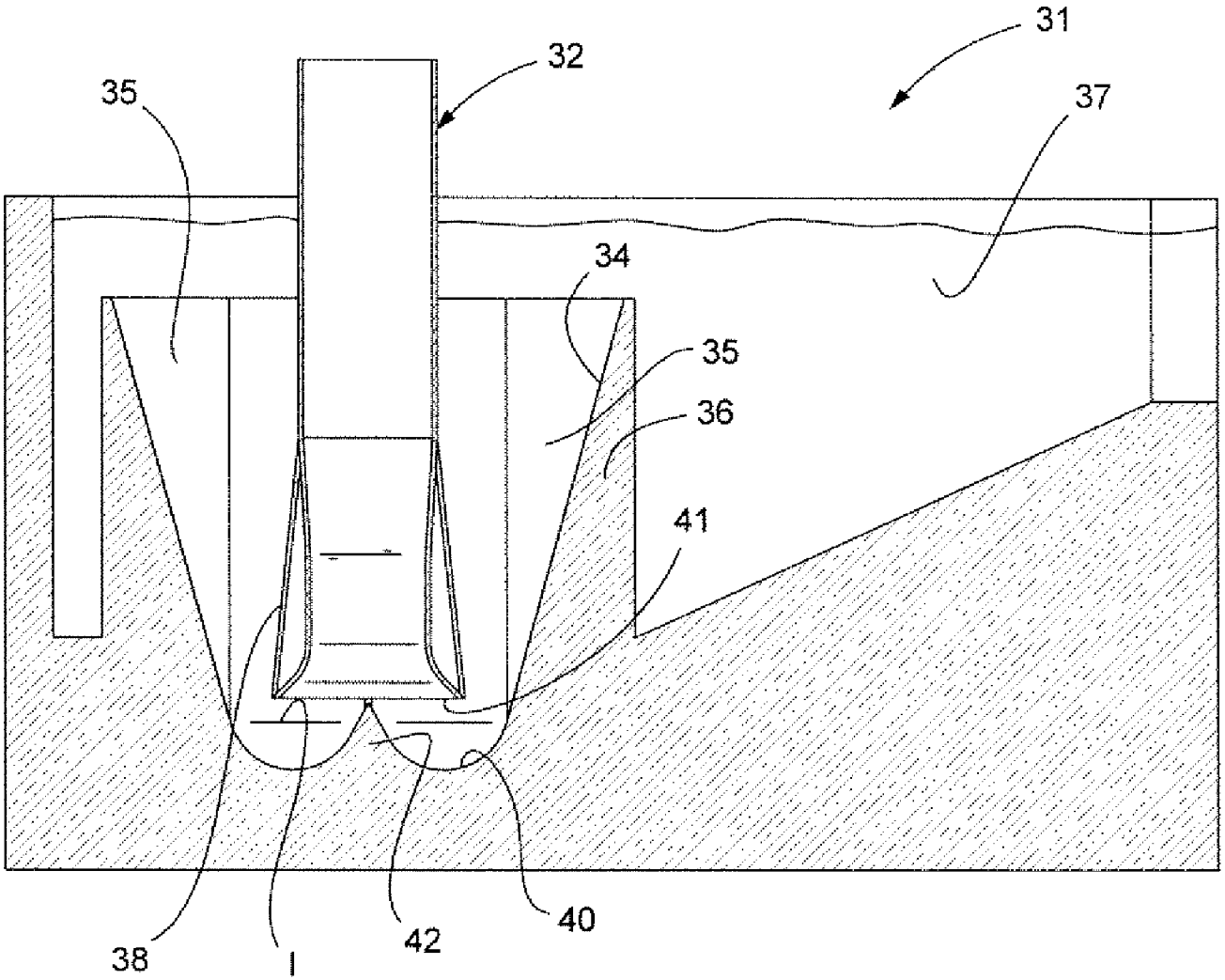
FIG. 3 is a cross-sectional side view of the pump intake assembly of FIG. 1.
Figure 4:
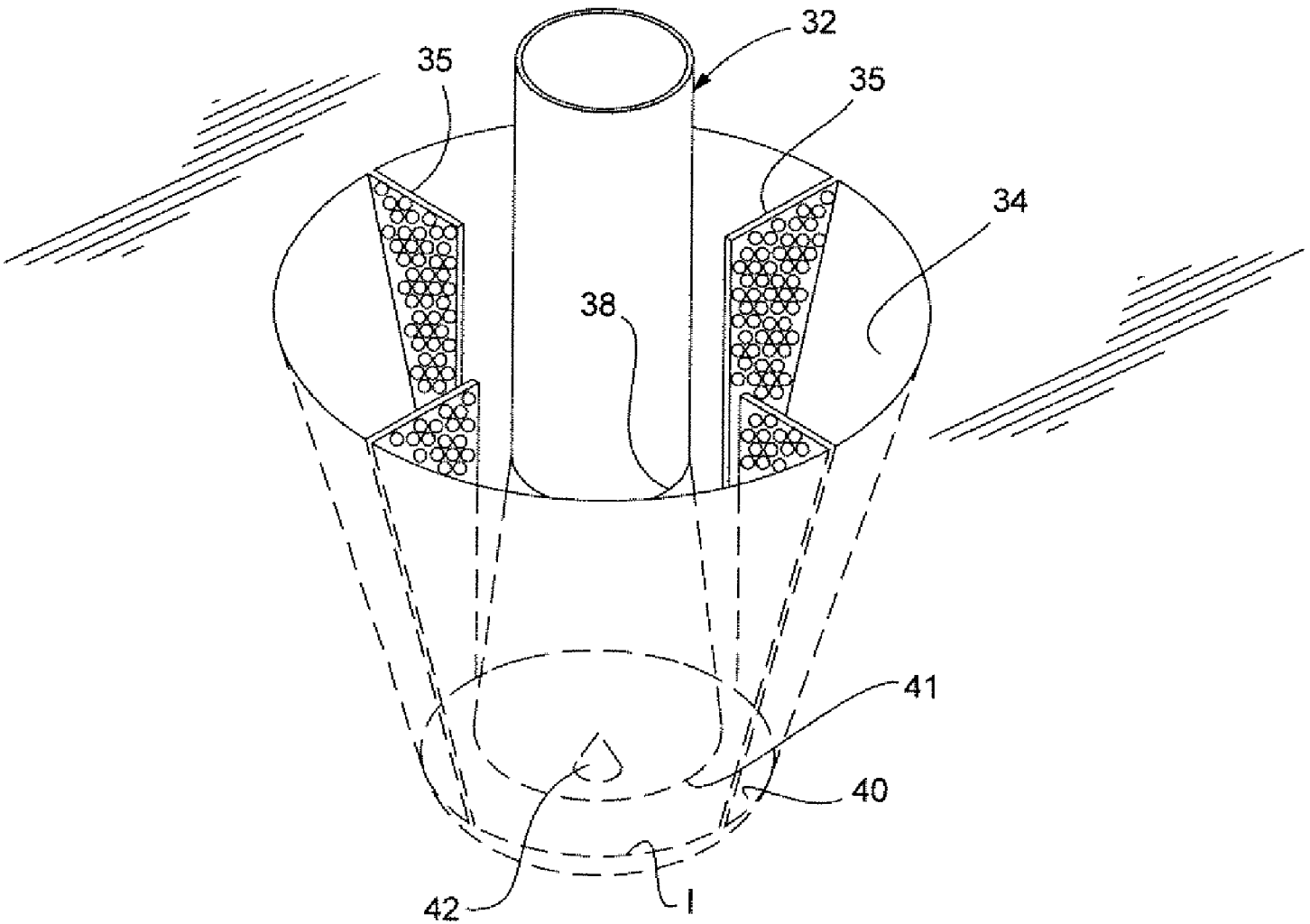
FIG. 4 is an enlarged isometric view of a pump intake pit of the pump intake assembly shown in FIG. 1.

Referring to FIG. 3, the cross section at the lower portion of the inverted cone is selected to produce a fluid velocity equal to or less than the fluid velocity as it enters the pump inlet bell 41. The pump intake floor section 40, includes a toroidal shape and hydrocone 42 to redirect the fluid as it passes the pump inlet bell to turn the fluid into the pump inlet without suffering a reduction in fluid velocity and concomitant turbulence. In the illustrated embodiment, the upper intake pit is conical with tapered walls. The intersection of the conical upper intake pit and the toroidal lower intake floor section 40 is illustrated by boundary line "I" in FIGS. 2-4. Alternatively, depending on the application, the inner surface of the upper intake pit may be configured with a vertical wall or include projections, patterns, and the like to modify the flow of fluid over the surface and flow rate toward the pump inlet bell.

The submergence, S, below the lowest intake basin operating level, expressed as a decimal fraction of the pump bell diameter D, has been shown by physical model studies to be 0.75 or less and meet all Hydraulic Institute requirements for swirl and other stability parameters.

Lower intake pit 40 includes a shape configured and dimensioned to redirect the flow of fluid into intake bell 41. In the illustrated embodiment, the lower intake pit is toroidally-shaped. Lower intake pit 40 further includes a projection member 42, a hydrocone that is formed by the closed center of the torus upwardly extending from a central region of the lower intake pit toward the pump bell. The lower intake pit has a substantially curvilinear surface interconnecting the narrow end of the inverted cone 34, with the bottom of the intake projection member 40. The pump bell and projection member together serve to redirect and accelerate fluid flow toward the pump bell. As the fluid flows down around the throat created by the narrow end of the cone and the outer rim of the pump bell 41, the projection member gradually redirects the flow in a reverse direction back upwards into the pump inlet bell, effecting a nearly seamless change in direction without significant loss of energy.

In practice, pump bell 41 is generally dimensioned by the pump manufacturer and all other features of the subject intake system may be customized to cooperate with the pump requirements.

One or more vanes 35 extend inwardly from inner surface of cone 34. The vane or vanes are configured to suppress rotation of a fluid flowing in the upper intake pit by preventing it from swirling or spiraling down the pump intake cone 34. In the illustrated embodiment, the pump intake pit includes four vanes spaced equidistantly along the inner surface of the upper intake pit. The vanes have a triangular shape and extend from near the submerged weir 33 of the pump intake cone to its lower intake edge. An inner edge of the vanes substantially parallels an outer surface of the pump column 32 and an outer edge is in contact with a wall of the intake cone 34.

The vanes may be further dimensioned and configured to minimize turbulence of fluid flowing over its surface. In one embodiment, the vanes have a smooth flat surface such that the fluid flow direction remains constant. In one embodiment, the vanes have a dimpled surface to create a header to the flow such that the fluid flows over the surface quicker (see FIG. 4). As will be understood by one skilled in the art, the vanes may be shaped or configured to modify the flow as desired for the particular application.

In one embodiment, the pump column 32 includes a shroud 39 around the bell and bowl assembly portion. As fluid flows along the outer surface of a conventional pump column, the bell and bowl shapes may encourage the formation of undesired vortices and eddy currents in the nook of the flared regions. In accordance with the present invention, shroud 39 extends from a lower end of the bell portion to an outer surface of the column 32 above the bowl assembly. The shroud has a substantially flat shape angled to create a tapering wall section in the downstream direction which resembles an inverted hopper. In this manner, trouble spots above the bell or bowl are isolated from the fluid flow path such that fluid flow is facilitated around the bell portion and vortices are suppressed. In the illustrated embodiment, the shroud completely covers the bell and bowl portion from the fluid flow.

In one embodiment, most of the surfaces in contact with the fluid flow are flat, curved, and/or angled to direct the fluid in a desired direction. However, one will appreciate that all the flow surfaces may include a variety of shapes and configurations to modify the flow. In one embodiment, the surfaces are dimpled so as to reduce the frictional forces over the surface. In another embodiment, the surfaces include projections to create a header to facilitate laminar flow and increase the flow rate to the pump.

The method of intake pump assembly in accordance with the present invention can now be described. In operation and use the pump is started and flow enters the intake basin 37 from any suitable opening, which may be equipped with screening devices to remove large debris. Weir 33 induces sufficient hydraulic loss as the fluid passes over it to effect uniform distribution of flow around the periphery of the rim of cone 4.

The flow path in operation and use can now be described. The fluid begins to flow laterally over weir 33 and cone 34 and into the intake pump pit. As the fluid flows over the weir, turbulent flow is minimized resulting in substantially turbulence-free flow over the top edge of the weir to the intake pump pit. This configuration minimizes vortex-inducing turbulence as the fluid flows to the upper portion of the pump intake.

The fluid then flows down into the intake pump pit between the inner surface of the wall of the intake pump pit and the pump column 32. As the upper intake pit orifice narrows downstream, that is, decreases in cross-sectional area, the fluid accelerates downward to intake floor 40. The fluid then flows past bell 41 down the intake pit 40. The shroud 39 minimizes turbulence as the fluid flows to a torus formed by the inner wall of the cone 34 and the outer rim of the pump bell 41. In contrast to conventional pump intake assemblies, the fluid flow is accelerated uniformly with few areas for potential development of vortices near the pump inlet bell.

At the bottom of the intake pump pit, hydrocone 42 coupled with the curvilinear shape of the floor of the lower floor 40 redirects the fluid into an upward direction.

In comparison to conventional pump intake assemblies which generally have a flat floor, resulting in an abrupt 90° change in direction, followed by a second abrupt 90° change as the fluid enters the pump inlet bell, turbulence is minimized and the fluid is less likely to swirl and produce vortices.

One will appreciate that the shape and configuration of lower floor 40 and hydrocone 42 may be modified depending on the application. For example, the flow of fluid into the pump may be based in part on the dimensions of the pump system 31. Smaller pump applications (e.g. one having a one foot diameter intake) may have practical requirements such that the lower floor may be substantially flat or of other geometric shapes and configurations to redirect and adjust the fluid flow towards the pump bell.

After redirection in the lower intake pit, the fluid flows upwards into intake pump inlet bell 41. The pump then discharges the fluid through to distribution. In this manner, fluid is accelerated toward the pump for increased flow rate and lower burden on the pump. Additionally, the intake pump assembly of the present invention greatly minimizes the formation of eddies, swirls, and vortices under normal operating conditions as opposed to conventional assemblies.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A wet pit pump intake assembly for directing fluid flow to a pump, the pump intake assembly comprising:

a pump intake column including a lower end having a pump bell; and a pump intake pit including an upper intake pit encircling the pump intake column and having a tapered inner surface providing the upper intake pit with a decreasing cross-sectional area to accelerate the fluid flow toward the pump bell, at least one vane extending inwardly from the inner surface of the upper intake pit, wherein the vane is configured to suppress rotation of a fluid flowing through the upper intake pit, and a lower intake pit floor positioned substantially below the pump bell and including a projection member upwardly extending from a central region of the lower intake pit floor toward the pump bell, the lower intake pit floor having a lower surface interconnecting the upper intake pit to the projection member, the lower surface configured to redirect and accelerate fluid flow toward the pump bell; and a shroud extending from the lower end of the pump intake column including a bowl and bell portion to the pump intake column, wherein the shroud is configured to facilitate acceleration of fluid flow toward the bell portion of the pump.

2. A wet pit pump intake assembly according to claim 1, in combination with a fluid basin having a weir extending upwardly from a floor of the fluid tank, wherein the pump intake assembly extends downwardly from the fluid tank floor and is configured to control the flow of fluid from the fluid tank into the pump bell.

3. A wet pit pump intake assembly according to claim 2, further comprising a distribution weir including a circular band having the pit entrance at its center.

4. A wet pit pump intake assembly according to claim 1, wherein the upper intake pit is in the shape of an inverted cone.

5. A wet pit pump intake assembly according to claim 4, wherein the lower intake pit floor is toroidally shaped.

6. A wet pit pump intake assembly according to claim 4, wherein a top point of the projection extends above a lower edge of the pump intake column.

7. A wet pit pump intake assembly according to claim 1, wherein the shroud completely covers the pump bowl and bell portion from the fluid flow.

8. A wet pit pump intake assembly as recited in claim 1, wherein the at least one vane has an inner edge substantially parallel to the pump intake column and an outer edge in contact with the pit tapered surface.

9. A wet pit pump intake assembly according to claim 1, wherein the at least one vane has a triangular shape.

10. A wet pit pump intake assembly according to claim 1, wherein the at least one vane is substantially flat.

11. A wet pit pump intake assembly according to claim 1, wherein the at least one vane is dimensioned and configured to minimize turbulence of fluid flowing over its surface.

12. A wet pit pump intake assembly according to claim 1, further comprising four or more vanes spaced equidistantly on the inner surface of the pit wall.

13. A wet pit pump intake assembly according to claim 1, wherein the lower surface is a substantially curvilinear surface interconnecting the upper intake pit to the projection member.

14. A wet pit pump intake assembly for directing fluid flow to a pump, the pump intake assembly comprising:

a pump intake column including a lower end having a pump bell; and a pump intake pit including an upper intake pit encircling the pump intake column and having a tapered inner surface providing the upper intake pit with a decreasing cross-sectional area to accelerate the fluid flow toward the pump bell, at least one vane extending inwardly from the inner surface of the upper intake pit, wherein the vane is configured to suppress rotation of a fluid flowing through the upper intake pit, and a lower intake pit floor positioned substantially below the pump bell and including a projection member upwardly extending from a central region of the lower intake pit floor toward the pump bell, the lower intake pit floor having a lower surface interconnecting the upper intake pit to the projection member, the lower surface configured to redirect and accelerate fluid flow toward the pump bell;

wherein the at least one vane is dimensioned and configured to minimize turbulence of fluid flowing over its surface; and wherein the at least one vane has a dimpled surface.

15. A wet pit pump intake assembly for directing fluid flow to a wet pit pump, the pump intake assembly comprising:

a pump intake column including a pump bell portion and a pump bowl portion; and a pump intake pit including an upper intake pit encircling at least the pump bell and having an inner surface providing the upper intake pit with a decreasing cross-sectional area to accelerate the fluid flow toward the pump bell, and a lower intake pit floor positioned substantially below the pump bell and including a projection member upwardly extending from a central region of the lower intake pit floor toward the pump bell to redirect fluid flow toward the pump bell;

wherein the wet pit pump intake assembly further includes a shroud extending from the lower end of the pump intake column and encircles the bowl portion and the bell portion, wherein the shroud is configured to facilitate acceleration of fluid flow toward the bell portion of the pump.

16. A wet pit pump intake according to claim 15, wherein the inner surface of the upper intake is tapered to accelerate the fluid toward the pump bell.

17. A wet pit pump intake according to claim 15, wherein the pump intake column includes at least one pump bowl portion, and the shroud encircles all of the pump bowl portions.

* * * * *